United States Patent [19]

Stein et al.

[11] Patent Number: 4,937,958

[45] Date of Patent: Jul. 3, 1990

[54] PICTURE FRAME

[76] Inventors: Berdie Stein, 61 Irving Pl. 3B, New York, N.Y. 10003; Thomas Dair, 438A Mountain View Ave., Valley Cottage, N.Y. 10989; Stephen Allendorf, 35 Bedford St. ∩18, New York, N.Y. 10014

[21] Appl. No.: 259,796

[22] Filed: Oct. 19, 1988

[51] Int. Cl.[5] ..... A47G 1/06

[52] U.S. Cl. ..... 40/156; 40/152; 40/155

[58] Field of Search ..... 40/152, 152.1, 154, 40/155, 156, 647

[56] References Cited

U.S. PATENT DOCUMENTS

| | | | |
|---|---|---|---|
| 1,904,318 | 4/1933 | Lehere | 40/154 |
| 2,777,232 | 1/1957 | Kulicke et al. | 40/155 |
| 2,785,490 | 3/1957 | Fabry | 40/156 |
| 3,425,147 | 2/1969 | Marx | 40/155 |
| 3,988,846 | 11/1976 | Kuhling | 40/156 |
| 4,030,220 | 6/1977 | Kotchen | 40/156 |
| 4,211,022 | 7/1980 | Angelakos | 40/156 |
| 4,498,255 | 2/1985 | Heard | 40/156 |
| 4,561,200 | 12/1985 | Hehn | 40/156 |
| 4,669,209 | 6/1987 | Pollack | 40/152.1 |
| 4,702,025 | 10/1987 | Mace | 40/156 |
| 4,736,538 | 4/1988 | Pierce et al. | 40/154 |
| 4,835,891 | 6/1989 | Joffe | 40/156 |

*Primary Examiner*—Gene Mancene
*Assistant Examiner*—Michael Lynch
*Attorney, Agent, or Firm*—Blakely, Sokoloff, Taylor & Zafman

[57] ABSTRACT

A frame having a rectangular tray with a centrally disposed flat portion. The flat portion is adapted to receive a picture or a photograph directly from the front of the frame. A cover can be placed over the picture. Rectangular holding members hold the picture in the tray. The holding members easily engage with a raised periphery which is adjacent to the centraol portion of the tray. The holding members are relatively large so as to be able to be easily grasped by a child.

9 Claims, 3 Drawing Sheets

Fig. 1
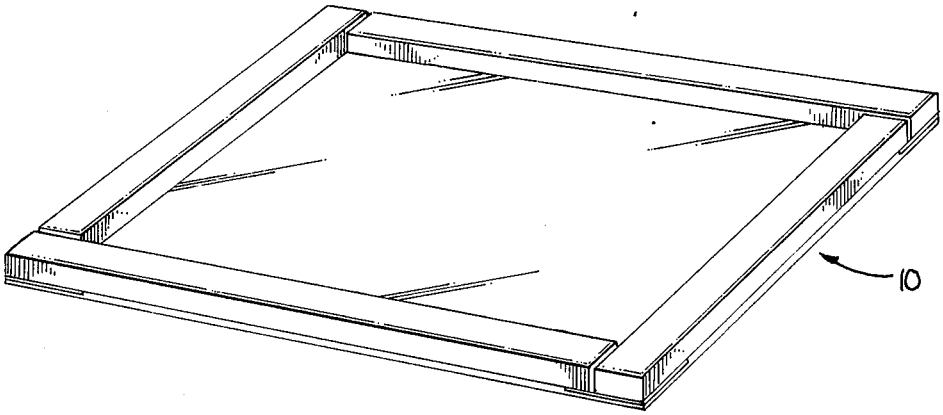
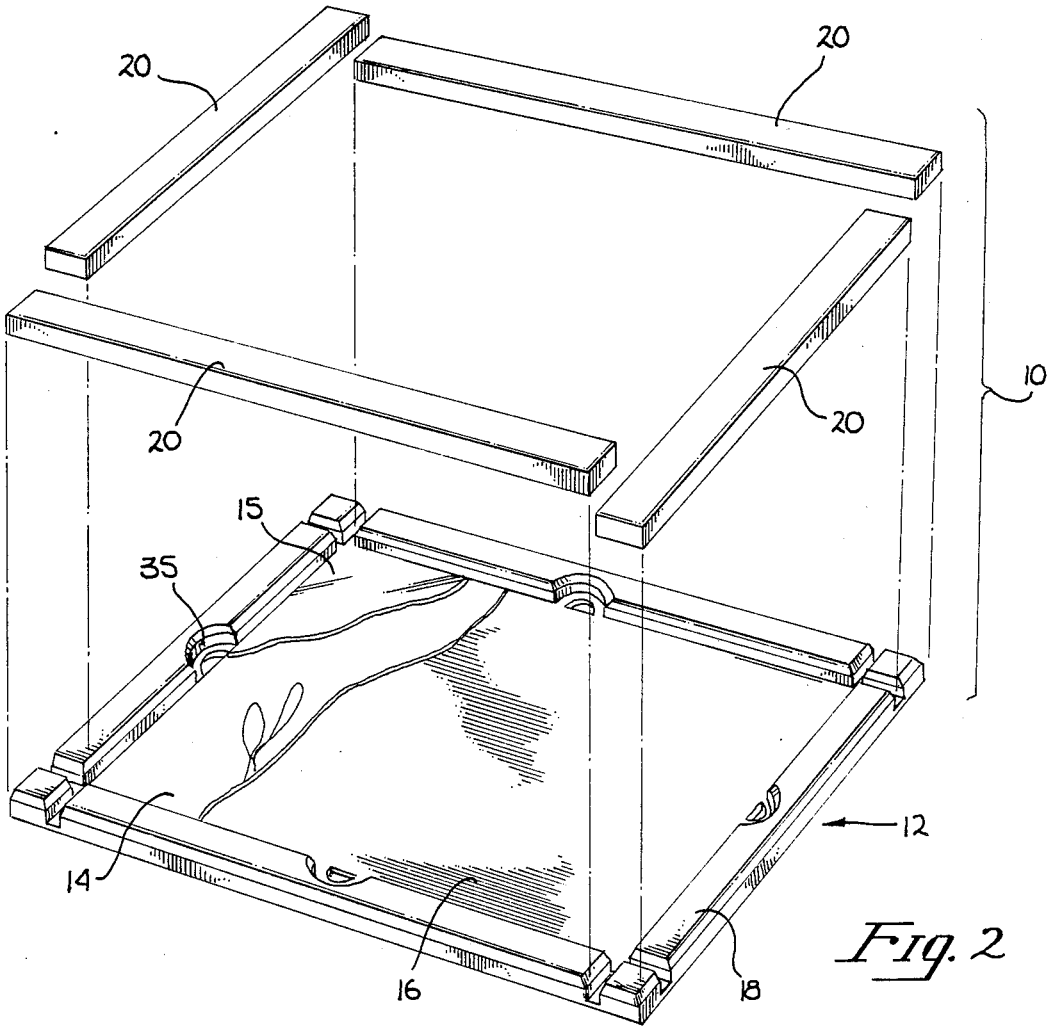
Fig. 2

20
23
19
22
18
25
18a
18b
16
15
14
31
30

PICTURE FRAME

FIELD OF THE INVENTION

This invention relates to the field of picture frames and more particularly to picture frames for use by children.

BACKGROUND OF THE INVENTION

In a typical picture frame, it is often a difficult task to properly insert the picture into the frame. This is because the picture must be inserted from the back of the frame, typically between a glass cover and a rigid backing. Moreover, once the picture is inserted into the frame, the frame must be fastened together by screws or other means. This complicates the use of the picture frame. These difficulties will in some instances prevent the frame from being re-used when the display of a new picture is desired. In other instances, the picture is permanently fixed within the frame after assembly, rendering a new use of the frame impossible.

Small children typically make drawings or paintings that they wish to have displayed. Often, children are unable to use traditional picture frames because of the above described difficulties. The necessity for using tools or small parts, such as screws, makes the use of traditional picture frames undesirable. Moreover, the presence of a glass cover can make such picture frames dangerous for children to use.

SUMMARY OF THE INVENTION

The present invention overcomes the above-described limitations by providing a picture frame that is easy to use. The frame consists of a rectangular tray with a centrally disposed flat portion. The flat portion is adopted to receive a picture or a photograph directly from the front of the frame. A cover can be placed over the picture. Rectangular holding members hold the picture in the tray. The holding members easily engage with a raised periphery which is adjacent to the central portion of the tray. The preferred embodiment of the present invention is made from plastic. The holding members are relatively large so as to be able to be easily grasped by a child

BRIEF DESCRIPTION OF THE DRAWINGS

FIG. 1 is a perspective view of the picture frame of the present invention.

FIG. 2 is a exploded perspective view showing the various components of the present invention.

DETAILED DESCRIPTION OF THE DRAWINGS

Figure 3:
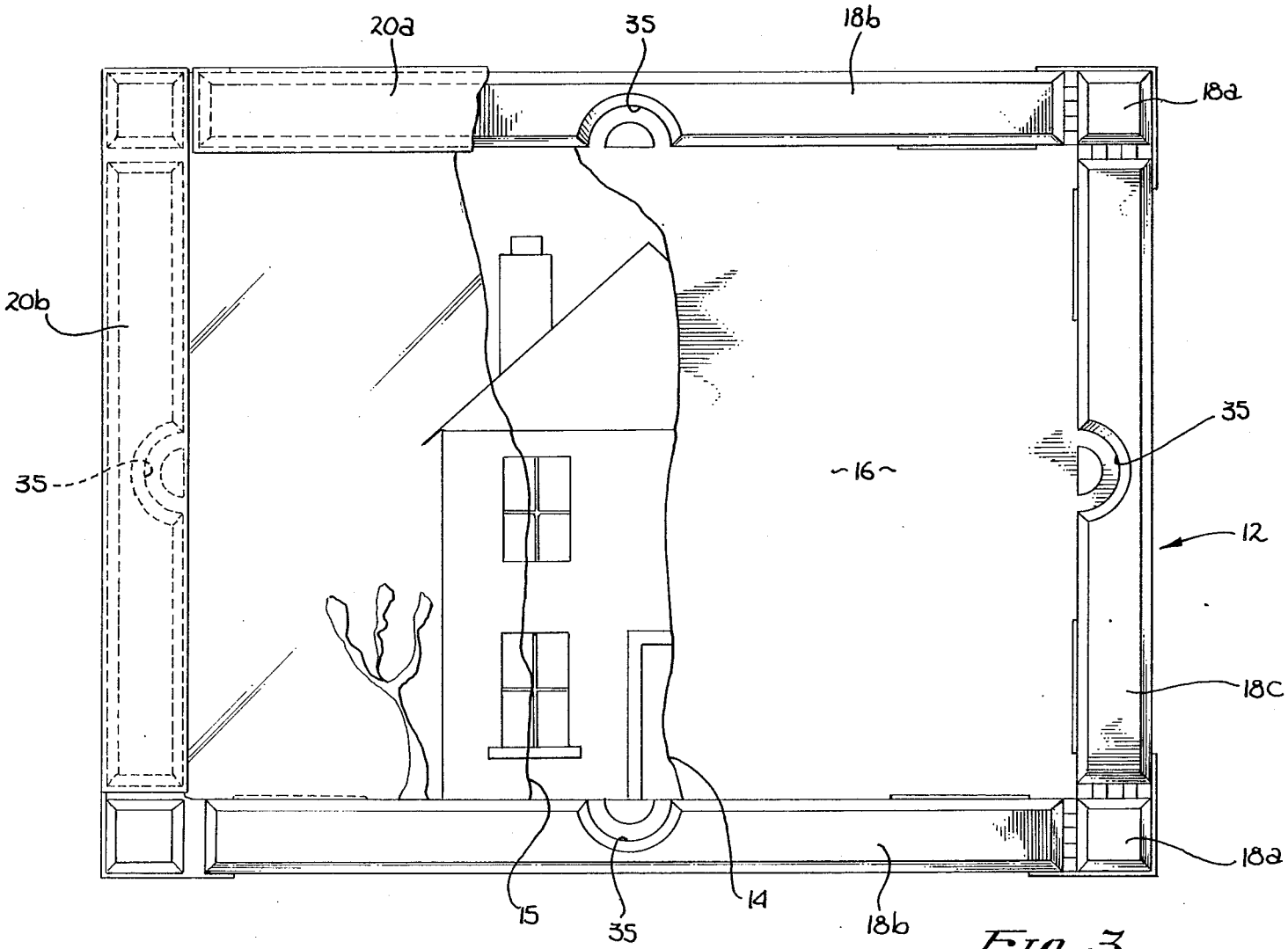
FIG. 3 is a plan view showing the tray used in the present invention and its relationship to other components in cuteway form.

A frame for holding pictures, photographs, and the like is disclosed. In the following description, specific arrangements and relationships are described in order to provide a better understanding of the present invention. In other instances, components and methods of manufacturing are not described in detail so as not to unnecessarily obscure the present invention. Moreover, the following description contains references to a picture or photograph which is placed in the frame. It is to be understood that the picture is not an element of the present invention. The invention is the picture frame itself. The picture is included in the description simply to provide a better understanding of the construction and use of the picture frame, and not as a limitation of the present invention.

Referring to FIG. 2, an exploded perspective view of the preferred embodiment of the present invention is shown. Frame 10 has a tray 12 for holding the picture or photograph 14. The picture 14 is placed into the tray from the front. The tray 12 has a flat central portion 16 and a raised periphery 18. The raised periphery 18 defines the outer boundaries of the central portion 16 and acts as a border to keep the picture 14 within the central portion 16. The raised periphery 18 also serves as an attachment point for the holding members 20.

A cover 15 is provided with the frame. The cover is placed in the tray 12 over the central portion 16. Recessed portions 35 in the raised periphery 18 allow for easy removal of the cover. In the preferred embodiment, the cover is made of a clear material. However, the cover can be colored or tinted if desired. The cover is not required, and can in fact be omitted. As shown best in FIG. 9, the holding members retain the cover 15 and picture 14 in the tray 12. When the holding member 20 is properly engaged with the raised periphery 18, an inner edge 22 of the holding member 20 overlaps with the cover 15 and picture 14. This prevents the cover 15 and picture 14 from falling out of the tray 12.

Figures 4, 5, 6, 7, 8, 9, 10, 11:
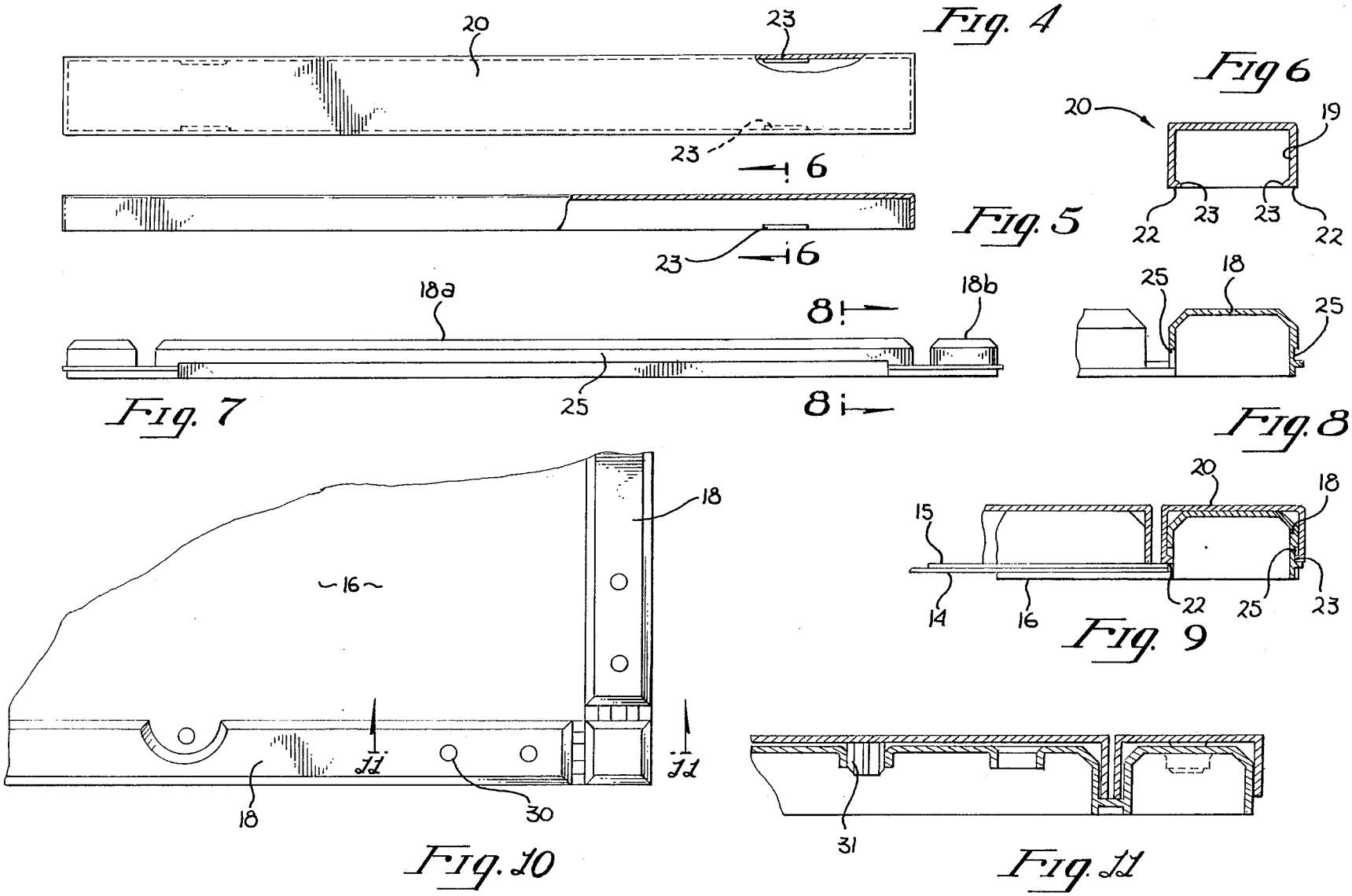
FIG. 4 is a top view of the preferred embodiment of a holding member.
FIG. 5 is a side view of the preferred embodiment of a holding member.
FIG. 6 is a cross-section of a holding member taken along the line 6—6.
FIG. 7 is a side view of the tray.
FIG. 8 is a partial cross section of the tray showing the recesses used to retain the holding members taken along the line 8—8.
FIG. 9 is a partial cross section of the tray showing the holding members engaged with the tray.
FIG. 10 is a plan view of the tray showing an alternative embodiment of the holding means.
FIG. 11 is a partial cross section of the tray taken along the line 11—11 showing the use of an alternative embodiment of the holding means to engage the holding members with the raised periphery.

The preferred embodiment has four holding members 20 which are removably engageable with the raised periphery 18. In the preferred embodiment, the holding members are rectangular and have a generally U-shaped cross section as shown in FIG. 6. The inside surface 19 of the holding member substantially conforms to the outer surface of the raised periphery 18. Located on the inside of the holding members 20 are four tabs 23. The tabs extend from the inner surface 19 of the holding member 20 The raised periphery 18 has integrally formed recesses 25 as best shown in FIGS. 8 and 9. There is one recess 25 to correspond with each tab 23. When the holding member 20 is placed onto the raised periphery 18, the tabs 23 engage with the recesses 25 and form a snap fit. Although four tabs and corresponding recesses are provided for each holding member in the preferred embodiment, it will be appreciated to those skilled in the art that the same result can be achieved with a larger or smaller number of tabs and recesses.

It will also be appreciated by those skilled in the art that various different means can be used to attach the holding members to the periphery. For example, FIGS.

10 and 11 show an alternative embodiment of the present invention. In this embodiment, the holding members are provided with a downwardly extending pin 31 instead of the tabs 23. The raised periphery 18 has a plurality of receptacles 30 for receiving the pins 31. When the holding member, in this embodiment, is placed onto the raised periphery the pins 31 engage with the receptacles 30 thus securely retaining the holding member 20 to the tray 12. It will be appreciated by those skilled in the art that various other methods of attaching the retaining member to the raised periphery can be utilized. For example, the raised periphery 18 and the inner edge 19 of the holding member 20 may be similar in size such that a form fit between the two elements is realized. Finally, the holding member 20 can be magnetically attached to the tray 12. In this case the holding member may engage with the raised periphery 18 or the periphery may be eliminated and the holding member can attach directly to the tray 12.

In the preferred embodiment, the holding members are relatively large so that they may be readily grasped by a child. However, they may be made any size which is suitable to hold the cover 15 and picture 14 in the tray.

Referring next to FIGS. 3 and 7, a more detailed description of the tray 12, will be given. As shown, the preferred embodiment of the raised periphery 18 consists of four elongated sections 18*b*, 18*c* and four square sections 18*a*. This arrangement allows for greater flexibility when engaging the holding members 20 with the tray 12 as described below.

In the preferred embodiment, the tray is rectangular in shape. Thus, all four holding members do not have the same length. There are two long holding members 20*a* and two short holding members 20*b*. When engaging the holding members with the raised periphery 18, the long members 20*a* are placed opposite from each other and the short members 20*b* are similarly situated. Since the holding members are of unequal length, the construction of the raised periphery is designed to allow greater flexibility in placing the holding members on the tray. The long holding members 20*a* are adopted to be placed along the top and bottom edges of the tray 12 and the short holding members 20*b* are placed along the sides of the tray 12. The holding members are not the same length as the side over which they are placed. Instead, the short holding members 20*b* have a length sufficient to cover one square portion 18*a* and one of the elongated portions 18*c* and the long holding members 20*a* have a length sufficient to cover one square portion 18*a* and one of the elongated portions 18*b*. Thus the short holding member 20*b* can be placed as shown in FIG. 3 covering the elongated portion 18*c* and the upper left square portions 18*a*. Alternatively, the short holding member 20*b* could be placed covering the lower left square portion 18*a* (this arrangement is not shown). The long holding members 20*a* are placed as shown in FIG. 3 It will thus be appreciated that in the preferred embodiment the holding members 20 can be mounted on the raised periphery 18 in two distinct arrangements. If only a single arrangement were possible, the user would be required to place the holding members in exactly the correct positions. Since small children may lack this skill, the present invention is particularly adapted for their use.

It will be appreciated by those skilled in the art that different shapes of the tray 12 and arrangements of the raised periphery 18 and the holding members 20 can be made without departing from the spirit of the present invention. For example, the tray may be circular in shape, and there can be two arcuate holding members, each in the form of a half-circle. However, it is desirable to have a design which allows the holding members to be placed on the periphery in a variety of arrangements.

The tray is also provided with a plurality of cut-out portions 33. These cut-outs allow the picture frame to be hung from a wall or other surface for display of the picture 14. In the preferred embodiment, there are four cut-outs 33, located at the edges of the central portion 16 and adjacent to the raised periphery 18. In the preferred embodiment, the cut-outs 33 have the shape of a semi-circle. This arrangement allows the picture to be displayed in a variety of orientations. It is therefore not necessary for a user to place the picture into the frame with its top edge adjacent to a particular side of the frame. Also, the semi-circle cut-out have the effect of properly aligning the frame so that it hangs straight when displayed. These are a desirable features for children who often do not pay attention to such details. It will be apparent to those skilled in the art, however, that a different number of cut-outs 33 may be used, and that the cut-outs may placed in a different location or have a different shape. FIG. 10 shows an alternative embodiment of the invention where the cut-outs are circular in shape. The only limitation on the cut-outs is that they should be able to facilitate the display of the picture 14 in a variety of orientations.

The tray 12, holding members 20, and cover 15 can be manufactured from any one of a number of the methods that are well-known in the art. In the preferred embodiment all of these components are made from injection molded plastic. This material is chosen because it is economical and allows the parts to be manufactured in a variety of colors. It will be apparent that different materials can be used. For example, the tray can be easily made of wood if a decorative frame is desired.

Accordingly, an improved design for a picture frame has been disclosed. The present invention makes the picture frame less difficult to use as compared to the prior art. The picture is placed into the tray from the top. A cover is then placed over the picture. The cover and picture are easily removable by means of the cut-outs in the tray and the recesses in the raised periphery. The holding members retain the picture and cover within the tray. The design of the frame makes it easily reusable and thus particularly suited for use by children.

We claim:

1. A picture frame for use by children comprising:

a tray having a centrally disposed flat portion for receiving pictures and photographs and a raised portion disposed at an outer periphery of said tray, said tray serving as a rigid backing for said pictures, said flat portion and said raised portion being disposed on a front side of said tray;

a cover placed over said flat portion;

a plurality of holding members removably engaged with said raised portions wherein when said holding members are engaged with said raised portions, an inner edge of said holding member extends over said flat portion and said cover so as to retain said cover in said tray;

wherein said tray further comprises at least one recess in said raised portion corresponding to each of said holding members and wherein each of said holding members has an inwardly extending tab disposed on an inner surface of said holding member.

2. The device of claim 1, wherein said holding members are rectangular in shape and have a substantially U-shaped cross section.

3. The device of claim 2 wherein there are four holding members.

4. The device of claim 1, wherein said raised portion comprises four substantially square elements located at each corner of said tray and four elongated elements disposed between each of said substantially square elements and extending peripherally adjacent to an outside perimeter of said tray.

5. The device of claim 4, wherein said tray further comprises at least one cut-out portion disposed adjacent to said flat portion.

6. The device of claim 5 wherein said at least one cut-out portion is in the shape of a semi-circle.

7. The device of claim 5 wherein said raised portion further comprises at least one indented portion adjacent to said flat portion and said cut-out portion.

8. The device of claim 5 wherein there are four cut out portions and four indented portions and wherein each of said indented portions and said cut-outs are located near the midpoint of each of said elongated elements.

9. The device of claim 1 wherein said tray, said cover, and said holding members are made from injection molded plastic.

* * * * *